US011572206B2

(12) United States Patent
Christman et al.

(10) Patent No.: US 11,572,206 B2
(45) Date of Patent: Feb. 7, 2023

(54) PACKAGING SYSTEM

(71) Applicant: Sealed Air Corporation (US), Charlotte, NC (US)

(72) Inventors: Russell T. Christman, Dunstable, MA (US); David Littlejohn, Gardner, MA (US); Gary Wood, Pelham, NH (US); James Michaelian, Palmer, MA (US); Thomas P. Orsini, Sterling, MA (US); Michael A. Kalinowski, Nashua, NH (US); John Gilbert, Lowell, MA (US)

(73) Assignee: Sealed Air Corporation (US), Charlotte, NC (US)

( * ) Notice: Subject to any disclaimer, the term of this patent is extended or adjusted under 35 U.S.C. 154(b) by 965 days.

(21) Appl. No.: 15/571,533

(22) PCT Filed: May 4, 2016

(86) PCT No.: PCT/US2016/030630

§ 371 (c)(1),
(2) Date: Nov. 3, 2017

(87) PCT Pub. No.: WO2016/179204

PCT Pub. Date: Nov. 10, 2016

(65) Prior Publication Data

US 2018/0141686 A1 May 24, 2018

Related U.S. Application Data

(60) Provisional application No. 62/157,164, filed on May 5, 2015.

(51) Int. Cl.
*B65B 9/067* (2012.01)
*B65B 57/14* (2006.01)
(Continued)

(52) U.S. Cl.
CPC ..... *B65B 9/067* (2013.01); *B65B 57/14* (2013.01); *B65B 59/001* (2019.05); *B65B 59/02* (2013.01);
(Continued)

(58) Field of Classification Search
CPC ..... B65B 9/067; B65B 61/025; B65B 57/14; B65B 59/02
See application file for complete search history.

(56) References Cited

U.S. PATENT DOCUMENTS 4,219,988 A 9/1980 King et al.
4,525,977 A 7/1985 Matt
(Continued)

FOREIGN PATENT DOCUMENTS

JP S63055039 A 3/1988
JP H10101005 A 4/1998
JP 2005314001 A 11/2005

OTHER PUBLICATIONS

International Search Report of PCT/US2016/030630, dated Nov. 10, 2016.
(Continued)

*Primary Examiner* — Anna K Kinsaul
*Assistant Examiner* — Daniel Jeremy Leeds
(74) *Attorney, Agent, or Firm* — Jon M. Isaacson

(57) ABSTRACT

A system for packaging includes a continuous flow wrap machine, a product reader, and a labeling unit. The product reader is configured to sense each product of the series of products transported on the infeed conveyor of the continuous flow wrap machine and to provide detected information for facilitating access to unique product information associated with each sensed product of the series of products. The labeling unit is adapted to apply visual representation of the unique product information to the tube formed in the
(Continued)

continuous flow wrap machine while the tube is moving or to the resulting packaged product while the packaged product is moving.

11 Claims, 4 Drawing Sheets

(51) Int. Cl.
*B65B 59/02* (2006.01)
*B65B 61/02* (2006.01)
*B65B 59/00* (2006.01)
*B65B 9/06* (2012.01)

(52) U.S. Cl.
CPC ..... *B65B 61/025* (2013.01); *B65B 2009/063* (2013.01)

(56) References Cited

U.S. PATENT DOCUMENTS 4,574,566 A * 3/1986 Eaves ..... B65B 9/067 53/450
4,722,168 A * 2/1988 Heaney ..... B65B 57/14 53/450
5,079,902 A 1/1992 Seko et al.
6,508,173 B1 * 1/2003 Focke ..... B65B 41/18 101/228
2004/0083688 A1 5/2004 Limousin
2004/0154270 A1 * 8/2004 Ishii ..... B65B 25/14 53/435
2006/0075329 A1 * 4/2006 Sullivan ..... B65B 61/26 715/221
2006/0218881 A1 10/2006 Sperry et al.
2006/0272291 A1 12/2006 Koke et al.
2010/0043349 A1 2/2010 Yuyama et al.
2015/0174848 A1 * 6/2015 Padros ..... B43M 5/047 493/239
2015/0353214 A1 12/2015 Gerstner et al.

OTHER PUBLICATIONS

Written Opinion of the International Searching Authority of PCT/US2016/030630, dated Nov. 10, 2016.

* cited by examiner

PACKAGING SYSTEM

This application claims the benefit of U.S. Provisional Application No. 62/157,164 filed May 5, 2015, which is incorporated herein in its entirety by reference.

The presently disclosed subject matter relates to a packaging system, for example, a packaging system including a continuous flow wrap machine.

BACKGROUND

Conventional packaging systems useful for mail-order shipping may operate in a step-wise or intermittent manner to package the products and apply label information. This can limit the speed with which the system operates. Adding to the complexity, not only can the size of the products to be packaged for shipment vary greatly, providing a differing or random stream of products to be packaged for mailing, but also the requirement for labeling information on the packaged product can vary depending on numerous inputs.

SUMMARY

One or more embodiments of the presently disclosed subject matter may address one or more of the aforementioned problems.

In an embodiment, a system for packaging includes a continuous flow wrap machine, a product reader, and a labeling unit. The continuous flow wrap machine includes a film dispenser for supplying a web of film and a transfer head for receiving the web of film from the film dispenser and redirecting the web of film to travel in a machine direction. The transfer head is adapted to manage the web of film to provide an interior space bounded by the film. The continuous flow wrap machine further includes an infeed conveyor for transporting a series of products and sequentially delivering in the machine direction a preceding product upstream from a following product from the series of products into the interior space of the film in repeating fashion. A longitudinal sealer is configured for continuously sealing the film together to form a tube enveloping the preceding product. An end sealer unit in configured so that in repeating fashion while the tube is traveling the end sealer unit (i) provides a trailing edge seal transverse to the tube upstream from the preceding product to create a packaged product, (ii) provides a leading edge seal transverse to the tube downstream from the following product, and (iii) severs the packaged product from the tube and between the trailing edge seal and the leading edge seal. The product reader is configured to sense each product of the series of products transported on the infeed conveyor and to provide detected information for facilitating access to unique product information associated with each sensed product of the series of products. The labeling unit is adapted to apply visual representation of the unique product information to the tube while the tube is moving or to the packaged product while the packaged product is moving.

In another embodiment, a flow wrap machine includes a film dispenser for supplying a web of film and a transfer head for receiving the web of film from the film dispenser and redirecting the web of film to travel in a machine direction. The transfer head is adapted to manage the web of film to provide an interior space bounded by the film. The machine includes an infeed conveyor for transporting a series of products and sequentially delivering in the machine direction a preceding product upstream from a following product from the series of products into the interior space of the film in repeating fashion. The infeed conveyor includes an incoming conveyor for transporting the series of products and a flow wrapper conveyor for receiving the series of products from the incoming conveyor. The flow wrapper conveyor is upstream from the transfer head. The incoming conveyor and flow wrapper conveyor are operable at differing conveying speeds relative each other to set the spacing between adjacent sequential products. A longitudinal sealer is configured for continuously sealing the film together to form a tube enveloping the preceding product. An end sealer unit is configured so that in repeating fashion while the tube is traveling the end sealer (i) provides a trailing edge seal transverse to the tube upstream from the preceding product to create a packaged product, (ii) provides a leading edge seal transverse to the tube downstream from the following product, and (iii) severs the packaged product from the tube and between the trailing edge seal and the leading edge seal. A product height sensor is configured to measure the height of each product of the series of products while transported on the incoming conveyor and to communicate the product height information for each product of the series of products to a controller configured to adjust the relative speeds of the incoming conveyor and the flow wrapper conveyor to set the spacing between adjacent sequential products based on a comparison of the product height information.

These and other objects, advantages, and features of the presently disclosed subject matter will be more readily understood and appreciated by reference to the detailed description and the drawings.

Various aspects of the subject matter disclosed herein are described with reference to the drawings. For purposes of simplicity, like numerals may be used to refer to like, similar, or corresponding elements of the various drawings. The drawings and detailed description are not intended to limit the claimed subject matter to the particular form disclosed. Rather, the intention is to cover all modifications, equivalents, and alternatives falling within the spirit and scope of the claimed subject matter.

DETAILED DESCRIPTION

Figure 2:
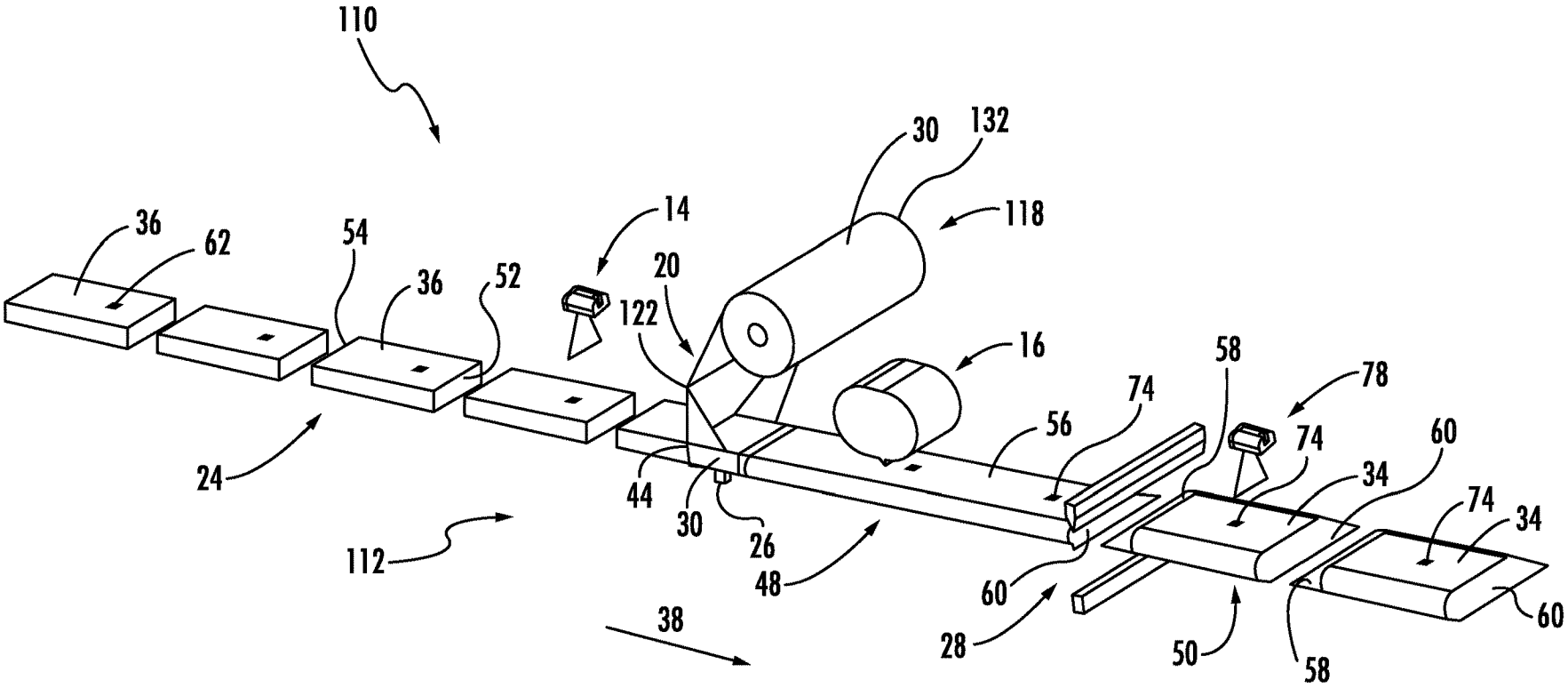
FIG. 2 is a representative schematic perspective view of another embodiment of a packaging system of the disclosed subject matter having a continuous flow wrap machine with a forming head.
Figure 3:
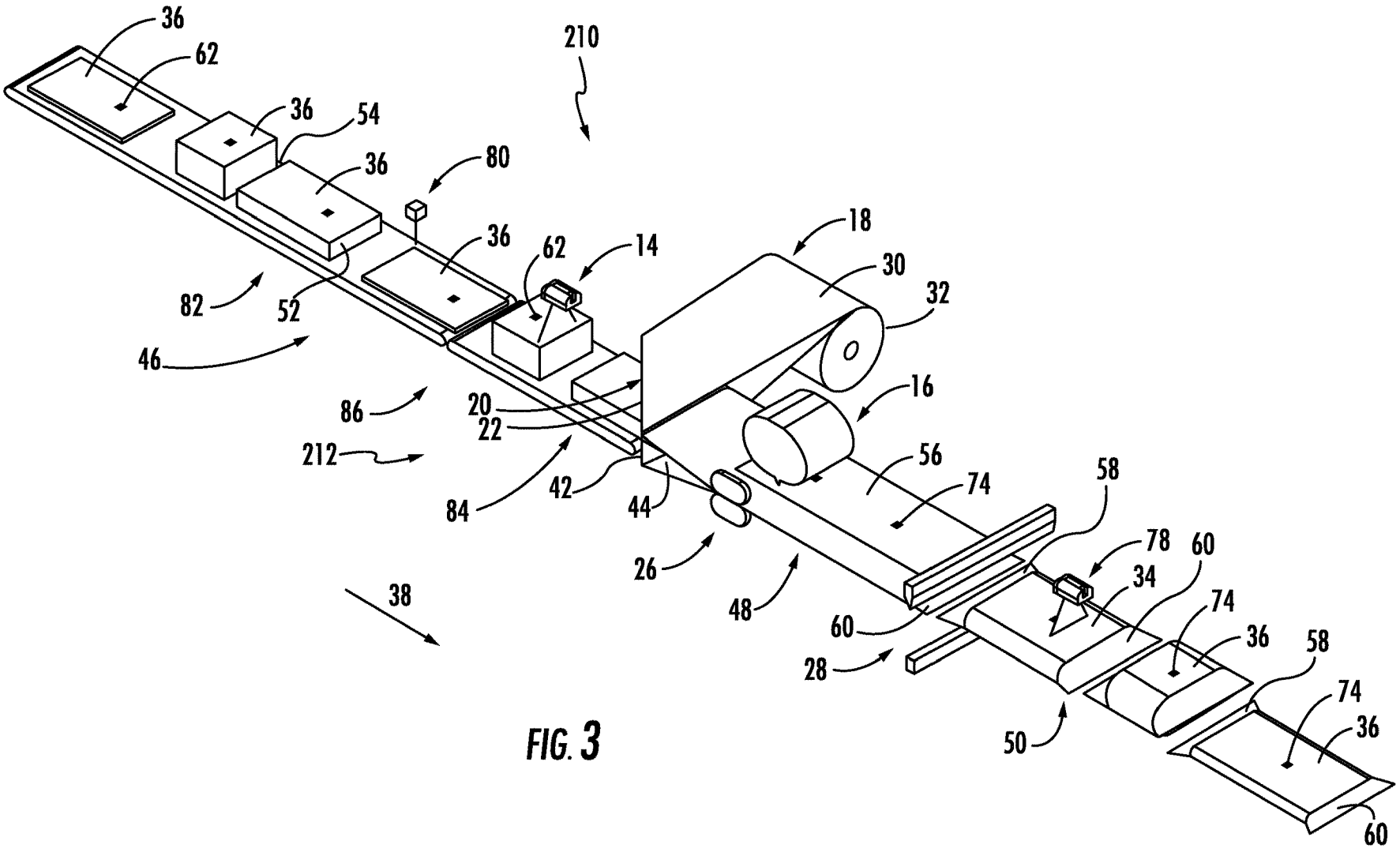
FIG. 3 is a representative schematic perspective view of still another embodiment of a packaging system of the disclosed subject matter having a product height sensor, an incoming conveyor, and a flow wrap conveyor.

In an embodiment of a packaging system of the disclosed subject matter, a packaging system (10, 110, and 210) includes a continuous flow wrap machine (12, 112, and 212), a product reader 14, and a labeling unit 16, as will be described in more detail herein. (FIGS. 1-3.)

Figure 4:
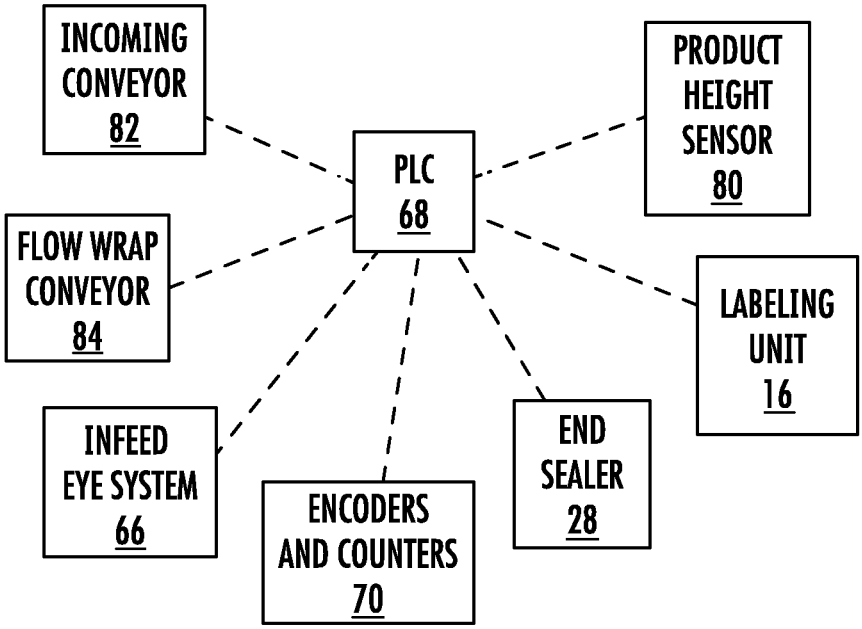
FIG. 4 is a representative schematic of the controller communications for an embodiment of the system.

In another embodiment of a packaging system of the disclosed subject matter, a flow wrap machine 212 includes a product height sensor 80 in communication with controller 68 to control and adjust the relative speeds of incoming conveyor 82 and flow wrapper conveyor 84, as will be described in more detail herein. (FIGS. 3-4.)

Continuous Flow Wrap Machine

Figure 1:
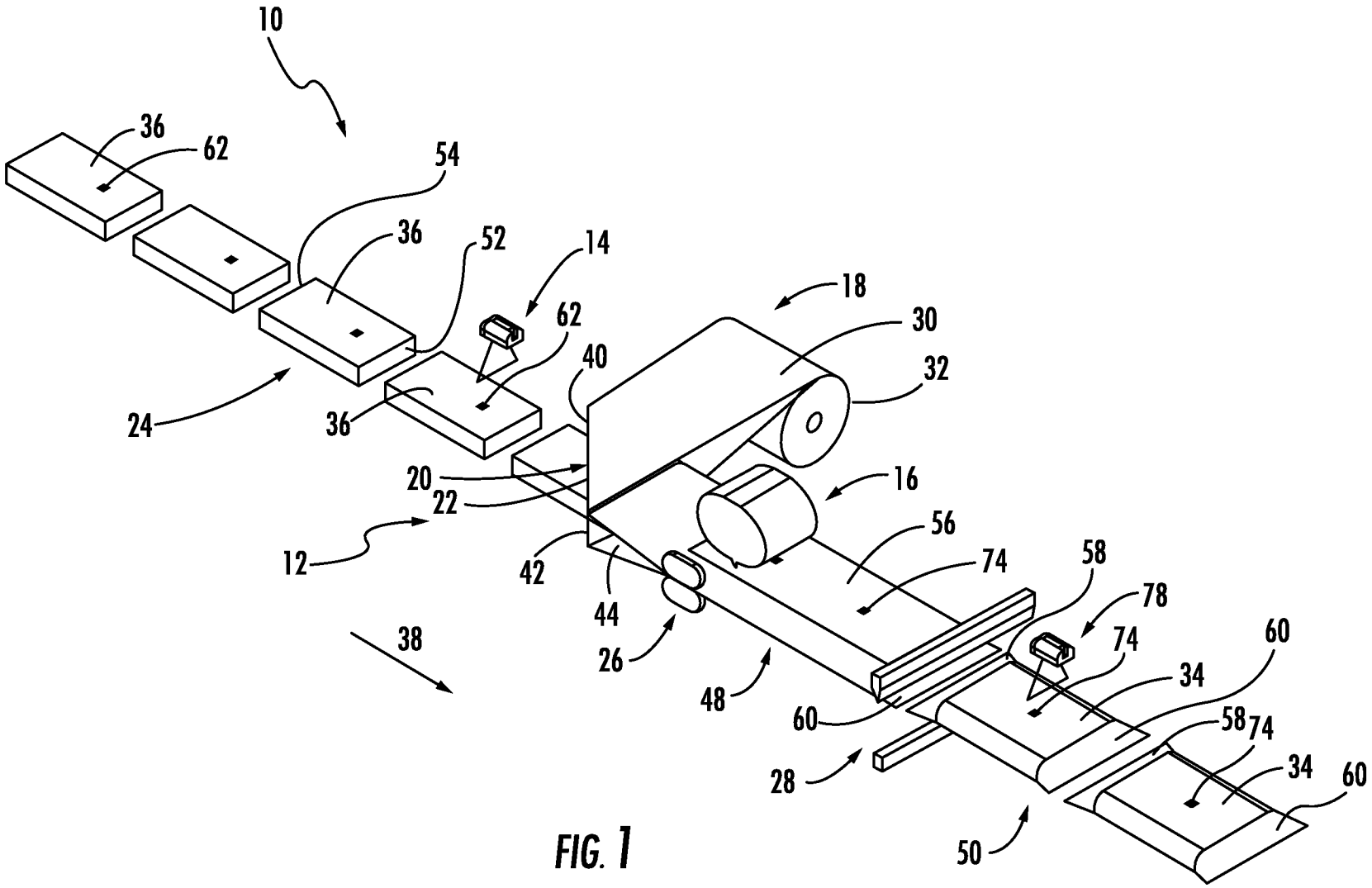
FIG. 1 is a representative schematic perspective view of an embodiment of a packaging system of the disclosed subject matter having a continuous flow wrap machine with an inverting head.

FIG. 1 shows packaging system 10 that includes a continuous flow wrap machine 12 (e.g., a form-fill-seal wrapper), which includes a film dispenser 18, a transfer head 20 including inverting head 22, an infeed conveyor 24, a longitudinal sealer 26, and an end sealer 28, as will be described in more detail herein. Continuous flow wrap machines are described, for example, in U.S. Pat. No. 4,219,988, which is incorporated herein in its entirety by reference, and are available from Sealed Air Corporation (Charlotte, N.C.) under the Shanklin FloWrap Series trademark.

Film Dispenser

Film dispenser 18 of continuous flow wrap machines 12, 112, and 212 (FIGS. 1-3) supplies a web of film 30 from roll 32. Systems for supplying webs of film are known in art and may include unwind mechanisms and other features. As shown in FIGS. 1 and 3, roll 32 contains a center folded film 30. As shown in FIG. 2, roll 132 contains flat wound film 30.

The film 30 may comprise any sheet or film material suitable for packaging a product 36, in particular for a package 34 for use as a mailer containing a product. Suitable materials include polymers, for example thermoplastic polymers (e.g., polyethylene) suitable for heat sealing.

The film 30 may have a thickness of any of at least 3, 5, 7, 10, and 15 mils; and/or at most any of 25, 20, 16, 12, 10, 8, 6 and 5 mils. The film may be multilayered, and have an outer layer adapted for heat sealing the film to itself to form a seal.

Transfer Head

The transfer head 20 of the continuous flow wrap machine receives the web of film 30 from the film dispenser 18. The transfer head 20 is adapted to manage (e.g., form) the web of film 30 into a configuration for eventual sealing into a tube.

As shown in FIGS. 1 and 3, the transfer head 20 in the configuration of an inverting head 22 of continuous flow wrap receives the center folded web of film 30 from the film dispenser 18 and redirects the web of film over the top and bottom inverting head arms 40, 42 to travel in the machine direction 38 by turning the web of film inside out. In this manner, the transfer head 20 is adapted to manage the web of film 30 to provide an interior space 44 bounded by film 30.

As shown in FIG. 2, the transfer head 20 in the configuration of a forming box 122 receives the lay flat web of film 30 from the film dispenser 18 and redirects the web of film over the forming head to travel in the machine direction 38 by turning the web of film inside out. In this manner, the transfer head 20 as forming head 122 is adapted to manage the web of film 30 to provide an interior space 44 bounded by film 30.

Conveyors

The infeed conveyor 24, 46 of continuous flow wrap machine 12, 112, 212, is adapted to transport a series of products 36 and sequentially deliver them in the machine direction 38. (FIGS. 1-3.) For example, the infeed conveyor may be adapted to convey a series of differing or randomly sized products 36, as illustrated in FIG. 3.

Within the series of products 36 in sequential order, a "preceding" product is upstream from a "following" product. The infeed conveyor 24, 46 is configured to deliver in repeating fashion a preceding product upstream from a following product into the interior space 44 of the web of film 30. The products 36 are delivered in spaced or gapped arrangement from each other. (FIGS. 1-3.)

A "product" 36 as used herein may comprise a single item for packaging, or may comprise a grouping of several distinct items where the grouping is to be in a single package. Further, product 36 may include an accompanying informational item, such as a packing slip, tracking code, a manifest, an invoice, or printed sheet comprising machine-readable information for sensing by product reader 14 (described herein).

The infeed conveyor 46 may include an incoming conveyor 82 for transporting the series of products and a flow wrapper conveyor 84 for receiving the series of products from the incoming conveyor 82. (FIG. 3.) The flow wrapper conveyor 82 is upstream from the transfer head 20. The incoming conveyor 82 is separated or spaced apart from the flow wrapper conveyor 84 by conveyor transfer area 86. The incoming conveyor 82 and flow wrapper conveyor 84 are operable at differing conveying speeds relative to each other to set the spacing between adjacent sequential products 36 on the conveyor. A controller, e.g., PLC 68, may be configured to adjust the relative speeds of the incoming conveyor 82 and the flow wrapper conveyor 84 to set the desired spacing between adjacent sequential products 36. (FIGS. 3-4.)

Downstream from the infeed conveyor 24, 46 is product conveyor 48, which is adapted to support and transport the web of film 30 and product 36 downstream together to the end sealer 28. Discharge conveyor 50 transports the series of packages 34 from the end sealer 28. (FIGS. 1-3.)

As each product 36 of the series of products sequentially travels through the continuous flow wrap machine 12, its position within the machine is tracked. This is accomplished by ways known in the art. For example, an infeed eye system 66 (horizontal or vertical) determines the location of the front edge 52 of each product and the location of the rear edge 54 of each product as the product travels along the conveyor. This location information is communicated to a controller 68 (i.e., a programmable logic controller or "PLC"). A system of encoders and counters 70, also in communication with the PLC 68, determines the amount of travel of the conveyor on which the product is positioned. In this manner, the position of the product 36 itself is determined and known by the PLC 68. The PLC 68 is also in communication with the end sealer unit 28 and labeling unit 16 (discussed herein) to provide the product position information for a particular product to these unit operations. (FIG. 4.)

Longitudinal Sealer

Continuous flow wrap machine 12 includes longitudinal sealer 26 adapted to continuously seal the film 30 together to form a tube 56 enveloping a preceding product 36. The longitudinal sealer 26 may be located at a side of the tube 56 (FIGS. 1, 3), where the sealer may form, for example, a side seal between two edge portions of the film 30. The longitudinal sealer 26 may be located beneath the tube 56 (FIG.

2), where the sealer may form, for example, a center fin seal between two edge portions of the web of film 30. As two edge portion of film 30 are brought together at the longitudinal sealer 26 to form the tube 56, they are sealed together, for example, by a combination of heat and pressure, to form a continuous fin or a side seal. Appropriate longitudinal sealers are known in the art, and include, for example, heat sealers.

End Sealer Unit

The continuous flow wrap machine 12 includes end sealer unit 28, which is adapted to provide or perform in repeating fashion, while the tube 56 is traveling: (i) a trailing edge seal 58 that is transverse to tube 56 and upstream from a preceding product to create packaged product 34 and (ii) a leading edge seal 60 transverse to the tube 56 and downstream from a following product. Further, the end sealer unit 28 is adapted to sever the packaged product 34 from the tube 56 by cutting between the trailing edge seal 58 and the leading edge seal 60. (FIGS. 1-3.) Generally, the end sealer unit 26 uses temperature and pressure to make two seals (trailing edge seal 58 and leading edge seal 60) and cuts between them, thus creating the final, trailing seal of one finished, preceding package and the first, leading edge seal of the following package. Advantageously, the end sealer unit may be adapted to simultaneously sever the packaged product 34 from the tube 56 while providing the trailing edge seal 58 and leading edge seal 60.

Useful end sealer units are known in the art. These include, for example, rotary type of end sealer units, having matched heated bars mounted on rotating shafts. As the film tube passes through the rotary type, the rotation is timed so it coincides with the gap between products. A double seal is produced and the gap between the two seals is cut by an integral blade to separate individual packs. Another type of end seal unit is the box motion type, having a motion that describes a "box" shape so that its horizontal movement increases the contact time between the seal bars and the film. Still another type of end sealer unit is the continuous type, which includes a sealing bar that moves down with the tube while sealing.

Product Reader

The packaging system includes a product reader 14. The product reader may be configured to sense each product 36 of the series of products that are transported on infeed conveyor 24 and to provide detected information which can be used to facilitate access to unique product information associated with each of the sensed products 36 of the series of products.

The product reader 14 may include any automated identification and data capture device, such as a bar code scanner, a laser sensor, a vision system, a digital camera, an ultraviolet sensor, or a radio frequency identification (RFID) reader, or other reader device.

Product 36 may include a machine-readable code 62 or symbol or other device or indicia for the product reader 14 to sense in order to provide detected information for accessing unique product information. As previously mentioned, product 36 may include an accompanying informational item such as a printed sheet comprising machine-readable information for sensing by product reader 14 to provide detected information. In such case, the product reader 14 may be adapted to sense a product code on such accompanying informational item.

In the situation where the product reader 14 includes, for example, a digital camera or similar scanner, the detected information itself (i.e., the digital image) may be the unique product information, in which case the detected information directly facilitates access to the unique product information.

The product reader 14 may be connected to communicate with a computer 64 (FIG. 5) to process the detected information provided by the product reader, as discussed in more detail herein. If desired, the product reader 14 may be connected to one or more of the labeling unit 16 and/or the PLC 68.

The unique product information may include information such as individualized shipping information (e.g., end-user destination information, name, address, shipping code, carrier bar code, tracking information, weight information, postage information, postage code), order information (e.g., order number, invoice information), content information (e.g., such as the number and/or type of items associated with the product, a description of the product, and manifest information).

Labeling Unit

The packaging system includes a labeling unit 16 that is adapted to apply visual representation 74 of the unique product information either (i) to the tube 56 while the tube is moving or (ii) to the packaged product 34 while the packaged product is moving. The labeling unit may include a printer configured for printing directly onto the tube 56 or packaged product 34, or the labeling unit may include a print and apply system for printing to a label and applying the label (e.g., by adhesive) to the tube 56 or the packaged product 34.

As shown in FIGS. 1-3, labeling unit 16 is located upstream from the end sealer unit 28 and is adapted to apply visual representation 74 of the unique product information to the tube while the tube is moving. Alternatively, the labeling unit may be located downstream from of the end sealer unit 28 and be adapted to apply visual representation 74 of the unique product information to the packaged product 34 while the packaged product is moving. (Not illustrated.)

The labeling unit 16 may include one or more of an inkjet printer or a laserjet printer, and be operable to print the visual representation of the unique product information on the tube or on the package. The labeling unit 16 may include a print and apply labeler.

Figure 5:
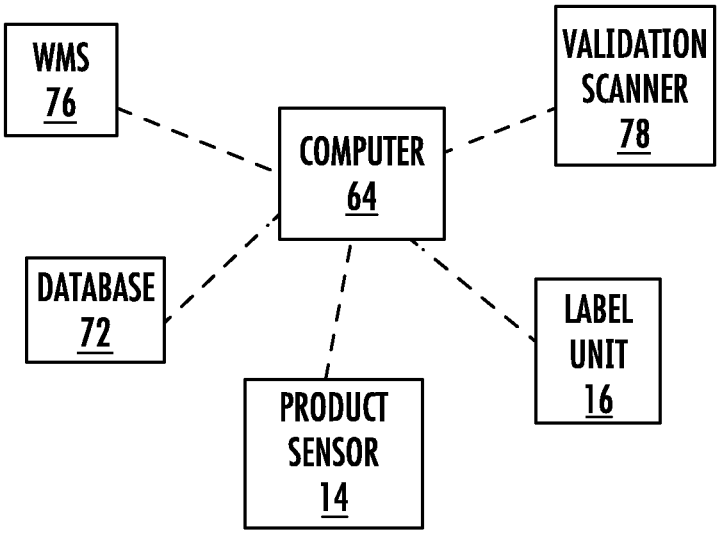
FIG. 5 is a representative schematic of the computer communications for an embodiment of the system.

The labeling unit may be adapted to receive the unique product information, for example from computer 64 or directly from product sensor 14. (FIG. 5.)

Computer

The packaging system may include a computer 64 comprising a microprocessor configured to receive the detected information from the product reader 14. (FIG. 5.) The computer 64 may be configured to look up and retrieve from a database 72 the unique product information that is associated with or correlated with the detected information of each sensed product 36 of the series of products. The labeling unit 16 may be in communication with the computer 64 to receive the unique product information for subsequent printing of the visual representation 74 of the unique product information. The computer may be in communication with a warehouse management system 76.

Validation Scanner

The packaging system may include a validation scanner 78 adapted to read the visual representation 74 of the unique product information from a packaged product 34 to provide validation information for verification. The validation scanner 78 may be located downstream from the end sealer unit 28. (FIGS. 1-3.) The validation scanner may be in communication with computer 64 to provide the validation information for verification.

Product Height Sensor

An embodiment of a packaging system may include a product height sensor 80. (FIG. 3.) This product height sensor aspect and its use as described herein may be incorporated with the packaging system embodiment including the product reader 14 and labeling unit 16 features as illustrated in packaging system 210 of FIG. 3, or this product height sensor aspect and its use as described herein may be utilized with a flow wrap machine independently (i.e., without the product reader and labeling unit features) and with or without the flow wrap machine being adapted to operate in a continuous manner.

The product height sensor 80 is a device for scanning the size or profile of the product 36, and may include, for example, any of light barrier arrays, ultrasonic sensors, and optical distance-measuring device (e.g., laser distance-measuring device).

The product height sensor 80 is configured to measure the height of each product 36 of the series of products, for example while transported on the incoming conveyor 82, and to communicate the resulting product height information for each product 36 of the series of products to a controller, for example, PLC 68. (FIGS. 3-4.) In this arrangement, the controller may be configured to adjust the relative conveying speeds of the incoming conveyor 82 and the flow wrapper conveyor 84 to set or control the spacing between adjacent sequential products 36 based on a comparison of the product height information (i.e., the height of a preceding product to the height of a following product). (FIGS. 3-4.) As a result, a desired spacing between adjacent products may be achieved for operations at the downstream end sealer unit 28, and the length of package 36 may be optimized (lengthened or shortened) depending on the size (i.e., height) of the product 36. For example, the space length between adjacent following and preceding products 36 may be managed to be equal to the height of the preceding product to be packaged plus the thickness of the seal bar of the end sealer unit 28.

For example, the incoming conveyor 82 and the flow wrapper conveyor 84 may each independently be operable at a stopped conveying speed to set the spacing between adjacent sequential products 36. The controller may be configured to adjust the relative conveying speeds of the incoming conveyor 82 and the flow wrapper conveyor 84 between a stopped conveying speed and a non-stopped conveying speed to set the spacing between adjacent sequential products 36 based on a comparison of the product height information.

The advantage of utilizing the product height sensor 80 in setting product spacing is that for feed of a series of products having differing or randomly sized (height) products, the flow wrap machine may be operated to optimize films usage and avoid film waste when a relatively "short" product of a series of differing sized products is packaged. In comparison, existing flow wrap machines are typically set up to operate for the relatively "tallest" expected product of the series of differing sized products to be packaged, thereby wasting film by using too much film to make a package oversized for what is optimal for a shorter product.

Use

In methods of use of the disclosed packaging systems, a series of products 36, which may have having differing sizes, is provided to a continuous flow wrap machine. Each incoming product 36 of the series of products is sensed (e.g., bar code scanning) to provide detected information associated with each sensed product. The unique product information associated with the detected information of each sensed product is accessed. A visual representation 74 of the unique product information to is applied either the tube 56 while the tube is moving or to the packaged product 36 while the packaged product is moving.

The unique product information associated with each sensed product 36 may be retrieved from a database 72 of a computer 64. The unique product information may then be communicated from the computer 64 to the labeling unit 16. The computer may be part of (i.e., interconnected to and interfacing with) a warehouse management system.

The visual representation 74 of the unique product information on the packaged product 36 may be verified by scanning the visual representation of the unique product information on the packaged product and comparing the scanned information to the unique product information associated with the detected information of the accessing step.

The step of sensing the product may use one or more of bar code scanning, laser sensing, a vision sensing, digitally imaging, ultraviolet sensing, or radio frequency identification device reading. The step of sensing may include sensing a product code on an informational item of the product 36 (i.e., accompanying the product).

The labeling unit may apply a visual representation 74 of the unique product information to the tube 56 while the tube is moving, for example, where the labeling unit 26 is upstream from the end sealer unit 28. The labeling unit may apply a visual representation 74 of the unique product information to the packaged product 34 while the packaged product is moving, for example, where the labeling unit 16 is downstream from of the end sealer unit 28.

In an embodiment, the end sealer unit 28 simultaneously severs the packaged product from the tube 56 while providing the trailing edge seal 58 and the leading edge seal 60.

In embodiments of methods of packaging comprising, a series of products 36, for example having differing sizes, may be provided to a continuous flow wrap machine as described herein. (FIG. 3.) The height of each product 36 of the series of products is measured while transported on the incoming conveyor 82. The product height information for each product 36 of the series of products is communicated to a controller 68 to compare the product height information of adjacent sequential products and adjust the relative speeds of the incoming conveyor and the flow wrapper conveyor to set the spacing between the adjacent sequential products. (FIG. 4.) The controller may adjust the relative speeds of the incoming conveyor 82 and the flow wrapper conveyor 84 between a stopped conveying speed and a non-stopped conveying speed to set the spacing between adjacent sequential products 36 based on the comparison of the product height information.

Any numerical value ranges recited herein include all values from the lower value to the upper value in increments of one unit provided that there is a separation of at least 2 units between any lower value and any higher value. As an example, if it is stated that the amount of a component or a value of a process variable (e.g., temperature, pressure, time) may range from any of 1 to 90, 20 to 80, or 30 to 70, or be any of at least 1, 20, or 30 and/or at most 90, 80, or 70, then it is intended that values such as 15 to 85, 22 to 68, 43 to 51, and 30 to 32, as well as at least 15, at least 22, and at most 32, are expressly enumerated in this specification. For values that are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. The definitions and disclosures set forth in the present Application control over any inconsistent definitions and disclosures that may exist in an incorporated reference. All references to ASTM tests are to the most recent, currently approved, and published version of the ASTM test identified, as of the priority filing date of this application. Each such published ASTM test method is incorporated herein in its entirety by this reference.

What is claimed is:

1. A system for packaging comprising:

a continuous flow wrap machine comprising:

a film dispenser for supplying a web of film;

a transfer head for receiving the web of film from the film dispenser and redirecting the web of film to travel in a machine direction, wherein the transfer head is adapted to manage the web of film to provide an interior space bounded by the film;

an infeed conveyor for transporting a series of products and sequentially delivering in the machine direction a preceding product upstream from a following product from the series of products into the interior space of the film in repeating fashion;

a longitudinal sealer for continuously sealing the film together to form a tube enveloping the preceding product; and an end sealer unit that in repeating fashion while the tube is traveling (i) provides a trailing edge seal transverse to the tube upstream from the preceding product to create a packaged product, (ii) provides a leading edge seal transverse to the tube downstream from the following product, and (iii) severs the packaged product from the tube and between the trailing edge seal and the leading edge seal;

a product reader configured to sense each product of the series of products transported on the infeed conveyor upstream of a location at which the series of products are delivered into the interior space of the film and to provide detected information for facilitating access to unique product information associated with each sensed product of the series of products; and a labeling unit adapted to apply, downstream of the location at which the series of products are delivered into the interior space of the film, visual representation of the unique product information to the tube while the tube is moving or to the packaged product while the packaged product is moving.

2. The system of claim 1 wherein:

the transfer head comprises an inverting head adapted to receive a web of folded film from the film dispenser; and the longitudinal sealer is located at a side of the tube.

3. The system of claim 1 wherein:

the transfer head comprises a forming head; and the longitudinal sealer is located beneath the tube.

4. The system of claim 1 wherein the infeed conveyor is adapted to transport a series of differing sized products.

5. The system of claim 1 further comprising a computer comprising a microprocessor configured to receive the detected information from the product reader and to retrieve from a database unique product information associated with each sensed product of the series of products, wherein the labeling unit is in communication with the computer to receive the unique product information.

6. The system of claim 1 wherein the product reader comprises one or more of a bar code scanner, a laser sensor, a vision system, a camera, an ultraviolet sensor, or an RFID reader.

7. The system of claim 1 wherein the product reader is adapted to sense a product code on an accompanying informational item of the product, the accompanying informational item comprising machine-readable information and selected from one or more of a packing slip, tracking code, a manifest, an invoice, or printed sheet.

8. The system of claim 1 wherein the labeling unit comprises a printer operable to print information on the tube.

9. The system of claim 1 wherein:

the infeed conveyor comprises:

an incoming conveyor for transporting the series of products; and a flow wrapper conveyor for receiving the series of products from the incoming conveyor;

the flow wrapper conveyor is upstream from the transfer head;

the incoming conveyor and flow wrapper conveyor are operable at differing conveying speeds relative each other to set the spacing between adjacent sequential products;

the system further comprises a product height sensor configured to measure the height of each product of the series of products while transported on the incoming conveyor and to communicate the product height information for each product of the series of products to a controller; and the controller is configured to adjust the relative speeds of the incoming conveyor and the flow wrapper conveyor to set the spacing between adjacent sequential products based on a comparison of the product height information.

10. The system of claim 9 wherein:

the incoming conveyor and flow wrapper conveyor are each independently operable at a stopped conveying speed to set the spacing between adjacent sequential products; and the controller is configured to adjust the relative speeds of the incoming conveyor and the flow wrapper conveyor between a stopped conveying speed and a non-stopped conveying speed to set the spacing between adjacent sequential products based on a comparison of the product height information.

11. The system of claim 10 wherein the product height sensor comprises a laser distance-measuring device.

* * * * *